US007995937B2

(12) United States Patent
Lee et al.

(10) Patent No.: US 7,995,937 B2
(45) Date of Patent: Aug. 9, 2011

(54) IMAGE FORMING APPARATUS AND CONTROL METHOD THEREOF

(75) Inventors: Jun-hee Lee, Suwon-si (KR); Dong-cheol Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 14 days.

(21) Appl. No.: 12/409,706

(22) Filed: Mar. 24, 2009

(65) Prior Publication Data

US 2010/0008682 A1 Jan. 14, 2010

(30) Foreign Application Priority Data

Jul. 14, 2008 (KR) ..... 2008-68353

(51) Int. Cl.
*G03G 15/00* (2006.01)

(52) U.S. Cl. ..... 399/44; 399/49; 399/66

(58) Field of Classification Search ..... 399/44, 399/66, 49

See application file for complete search history.

(56) References Cited

U.S. PATENT DOCUMENTS 7,593,655 B2 * 9/2009 Nishida et al. ..... 399/49
2004/0042808 A1 * 3/2004 Suzumi et al. ..... 399/66

* cited by examiner

*Primary Examiner* — Hoang Ngo
(74) *Attorney, Agent, or Firm* — Stanzione & Kim, LLP

(57) ABSTRACT

An image forming apparatus and a control method thereof are provided. The image forming apparatus includes: an image carrying body which includes a surface on which a developer which corresponds to printing data is applied; a transferring unit which receives transferring electric power to form a transferring area which transfers the developer to a transferring target body; a power supply unit which applies transferring electric power to the transferring unit; and a control unit which controls the power supply unit to apply first transferring electric power or second transferring electric power based on the amount of the developer in a unit section on a surface of the image carrying body. Thus, the present general inventive concept provides an image forming apparatus and a control method thereof for improving a printing image quality.

27 Claims, 18 Drawing Sheets

IMAGE FORMING APPARATUS AND CONTROL METHOD THEREOF

CROSS-REFERENCE TO RELATED APPLICATIONS

This application claims priority from Korean Patent Application No. 10-2008-0068353, filed on Jul. 14, 2008 in the Korean Intellectual Property Office, the disclosure of which is incorporated herein by reference in its entirety.

BACKGROUND OF THE INVENTION

1. Field of the Invention

The present invention relates to an image forming apparatus and a control method thereof, and more particularly, to an image forming apparatus and a control method thereof improving an image quality.

2. Description of the Related Art

An image forming apparatus forms an image corresponding to printing data on a printing medium, and includes an electric copier, a printer, a scanner, a facsimile, a multifunction device integrating a part or all of functions thereof, etc.

As shown in FIG. 1, a conventional image forming apparatus 1 includes an image carrying body 13, a charging roller 11 charging a surface of the image carrying body 13, a light exposing unit 16 exposing the surface of the charged image carrying body 13 to form an electrostatic latent image corresponding to printing data, a developing roller 12 applying a developer to the electrostatic latent image of the surface of the image carrying body 13 to form a visible image, and a transferring roller 14 transferring the developer on a printing medium P.

However, if a gray image is outputted by using the conventional image forming apparatus 1 of FIG. 1, then an image having a stripe in a middle part thereof may be outputted as illustrated in FIG. 2A. FIG. 2B simplifies the image pattern of FIG. 2A, and shows that the stripe shown in FIG. 2A is visible to the naked eye in case of an image pattern configured with a black image area b having a high density in a front end of the printing medium P, and a gray image area g having a slightly low density next to the black image area b.

As shown in FIGS. 2A and 2B, it shows that an unexpected stripe j occurs to a portion distanced from the deep black image area b by approximately 75 mm apart.

FIGS. 3A to 3C are actual measuring graphs respectively measuring variations according to time of a surface electric potential of the image carrying body 13, a feedback voltage of the transferring roller 14 and a transferring voltage of the transferring roller 14 when an image of FIG. 2B is printed by using the conventional image forming apparatus 1. The surface electric potential of the image carrying body 13 is measured by means of a non-contracting sensor 15 sensing a surface electric potential.

The letter c in FIG. 3A shows that the surface electric potential varies from approximately −700V to −150V as a surface of the image carrying body 13 corresponding to the width w of the deep black image area b of the front end of the printing medium is totally exposed by means of the light exposing unit 16. The letter k in FIG. 3A highlights the surface electric potential of the image carrying body 13 varies from approximately −700V to −350V by means of the light exposing unit 16 to correspond to the gray image area g which follows the deep black image area b.

In FIG. 3B, the feedback voltage of the transferring roller 14 is a voltage feedback according to time, which is measured by applying a voltage for sensing to the transferring roller 14.

If the image carrying body 13 and the transferring roller 14 are respectively regarded as resistors and the voltage for sensing is applied thereto as power, a kind of virtual closed circuit is configured. The feedback voltage is a voltage converted from a current flowing through the virtual closed circuit. The letter e in FIG. 3B highlights the moment when the printing medium P enters a transferring nip N between the image carrying body 13 and the transferring roller 14. The drop in feedback voltage highlighted by e occurs because the printing medium P may be regarded as a resistor newly added to the virtual closed circuit, and accordingly, the feedback voltage decreases.

As shown in FIG. 3C, the transferring voltage of the transferring roller 14 increases coincidentally at a point in time when the printing medium P enters a transferring nip N between the image carrying body 13 and the transferring roller 14.

The letter f in FIG. 3B highlights that the feedback voltage abruptly decreases when a surface of the image carrying body 13 corresponding to a portion c in FIG. 3A enters the transferring nip N.

Also, the letter d in FIG. 3A shows that the surface electric potential of the image carrying body 13 exposed to print the gray image area g in FIG. 2(B) is overshot, and the absolute value thereof becomes smaller than a circumference. This means that if there is a potential difference rapid change section m in which a sudden potential difference is generated to the surface of the image carrying body 13 at about time t1, an effect thereof still exists although the potential difference rapid change section m passes through the charging unit 11.

More specifically, although the image carrying body 13 makes one revolution so that the potential difference rapid change section m can be exposed again by means of the light exposing unit 16 to print the gray image area g, a peak value thereof reaches a surface electric potential larger (the absolute value thereof is smaller) than a surface electric potential of the circumference, −350V as represented as d in FIG. 3A. Accordingly, since a developer charged with a negative charge is concentrated to a surface of the image carrying body 13 having a relatively smaller electric potential than the circumference (a part corresponding to t3 in FIG. 3A), the stripe j becomes visible to the naked eye as shown in FIGS. 2A and 2B, that is, an image ghost appears.

SUMMARY OF THE INVENTION

Accordingly, embodiments of the present general inventive concept provide an image forming apparatus and a control method thereof, which improve printing image quality.

Embodiments of the present general inventive concept provide an image forming apparatus and a control method thereof, which improves space efficiency.

Embodiments of the present general inventive concept provide an image forming apparatus and a control method thereof, which reduces manufacturing cost.

Additional embodiments of the present general inventive concept will be set forth in part in the description which follows and, in part, will be obvious from the description, or may be learned by practice of the general inventive concept.

Embodiments of the present general inventive concept can be achieved by providing an image forming apparatus, including: an image carrying body which includes a surface on which a developer which corresponds to printing data is applied a transferring unit which receives transferring electric power to form a transferring area which transfers the developer to a transferring target body; a power supply unit which applies transferring electric power to the transferring unit;

and a control unit which controls the power supply unit to apply first transferring electric power or second transferring electric power based on the amount of the developer in a unit section on a surface of the image carrying body.

The control unit may control the power supply unit to apply the second transferring electric power to the transferring unit while a first unit section passes through the transferring area if a first developer amount in the first unit section is larger than a first reference value.

The control unit may control the power supply unit to change the transferring electric power from the first transferring electric power to the second transferring electric power if a difference between the first developer amount and a second developer amount in a second unit section is larger than a predetermined amount gap.

The first unit section and the second unit section may be vicinal to each other, or the second unit section may be overlapped with the first unit section as the image carrying body makes one revolution.

The control unit may control the power supply unit to change the second transferring electric power depending on at least one of temperature, humidity and the amount gap.

The control unit may control the power supply unit so that the second transferring electric power can be in proportion to the amount gap, or the second transferring electric power can be in inverse proportion to the temperature or humidity.

The control unit may control the power supply unit to apply the second transferring electric power to the transferring unit while a first unit section passes through the transferring area if a first developer amount in the first unit section is larger than a first reference value, and a second developer amount in a second unit section is smaller than a second reference value.

The control unit may control the power supply unit to apply a third transferring electric power to the transferring unit after applying the first transferring electric power and the second transferring electric power to the transferring unit.

The first transferring electric power and the third transferring electric power may have the same level.

The control unit may control the power supply unit to apply the first transferring electric power to the transferring unit after the first unit section passes through the transferring area.

The absolute value of the second transferring electric power may be larger than that of the first transferring electric power.

The image forming apparatus may further include a memory which stores information about at least one of the first transferring electric power and the second transferring electric power.

The printing data may include bitmap data, and the control may calculate the developer amount in the unit section by using the bitmap data.

Embodiments of the present general inventive concept can be achieved by providing a control method of an image forming apparatus which may include an image carrying body which may include a surface on which a developer which corresponds to printing data is applied, and a transferring unit which may receive transferring electric power to form a transferring area which transfers the developer to a transferring target body, the control method of the image forming apparatus including: applying first transferring electric power to the transferring unit; and applying second transferring electric power to the transferring unit based on the amount of the developer in a unit section on a surface of the image carrying body.

Applying the second transferring electric power may include applying the second transferring electric power while a first unit section passes through the transferring area if a first developer amount in the first unit section is larger than a first reference value.

Applying the second transferring electric power may further include applying the second transferring electric power if a difference between the first developer amount and a second developer amount in a second unit section is larger than a predetermined amount gap.

The first unit section and the second unit section may be vicinal to each other, or the second unit section may be overlapped with the first unit section as the image carrying body makes one revolution.

The control method of the image forming apparatus may further include selecting the second transferring electric power depending on at least one of temperature, humidity and the amount gap.

The second transferring electric power may be in proportion to the amount gap, or is in inverse proportion to the temperature or humidity.

Applying the second transferring electric power may include applying the second transferring electric power while a first unit section passes through the transferring area if a first developer amount in the first unit section is larger than a first reference value, and a second developer amount in a second unit section is smaller than a second reference value.

The control method of the image forming apparatus may further include applying third transferring electric power to the transferring unit after applying the first transferring electric power and the second transferring electric power to the transferring unit.

The first transferring electric power and the third transferring electric power may have the same level.

The control method of the image forming apparatus may further include applying the first transferring electric power to the transferring unit again after the first unit section passes through the transferring area.

The absolute value of the second transferring electric power may be larger than that of the first transferring electric power.

The control method of the image forming apparatus may further include storing information about at least one of the first transferring electric power and the second transferring electric power.

The printing data may include bitmap data, and the control method of the image forming apparatus may further include calculating the developer amount in the unit section by using the bitmap data.

A control method of an image forming apparatus which comprises an image carrying body which comprises a surface on which a developer for printing data is applied, and a transferring unit which receives transferring electric power to form a transferring area which transfers the developer to a transferring target body, the control method of the image forming apparatus comprising: applying first transferring electric power to the transferring unit; and applying second transferring electric power to the transferring unit based on a density gap between a first developer density at a first unit section on the surface of the image carrying body and a second developer density at a second unit section on the surface of the image carrying body for preventing the formation of an image ghost due to inequality of surface electric potential of the image carrying body.

BRIEF DESCRIPTION OF THE DRAWINGS

Embodiments of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
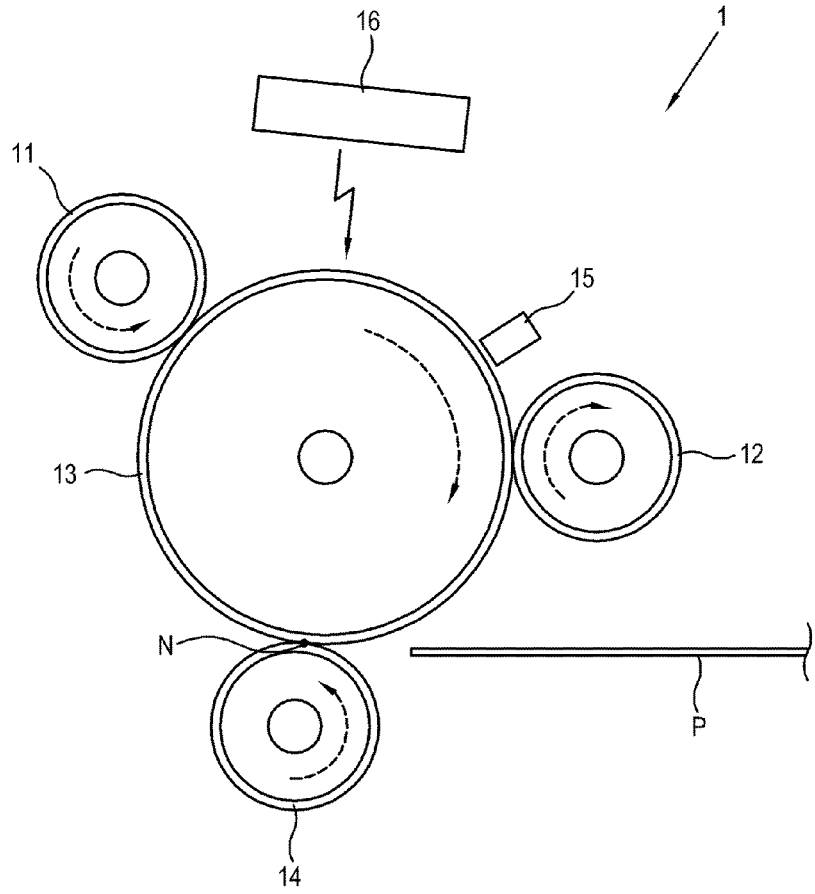
FIG. 1 is a schematic view of a conventional image forming apparatus 1.

Reference will now be made in detail to the embodiments of the present general inventive concept, examples of which are illustrated in the accompanying drawings, wherein like reference numerals refer to like elements throughout. The exemplary embodiments are described below so as to explain the present general inventive concept by referring to the figures.

Figure 4:
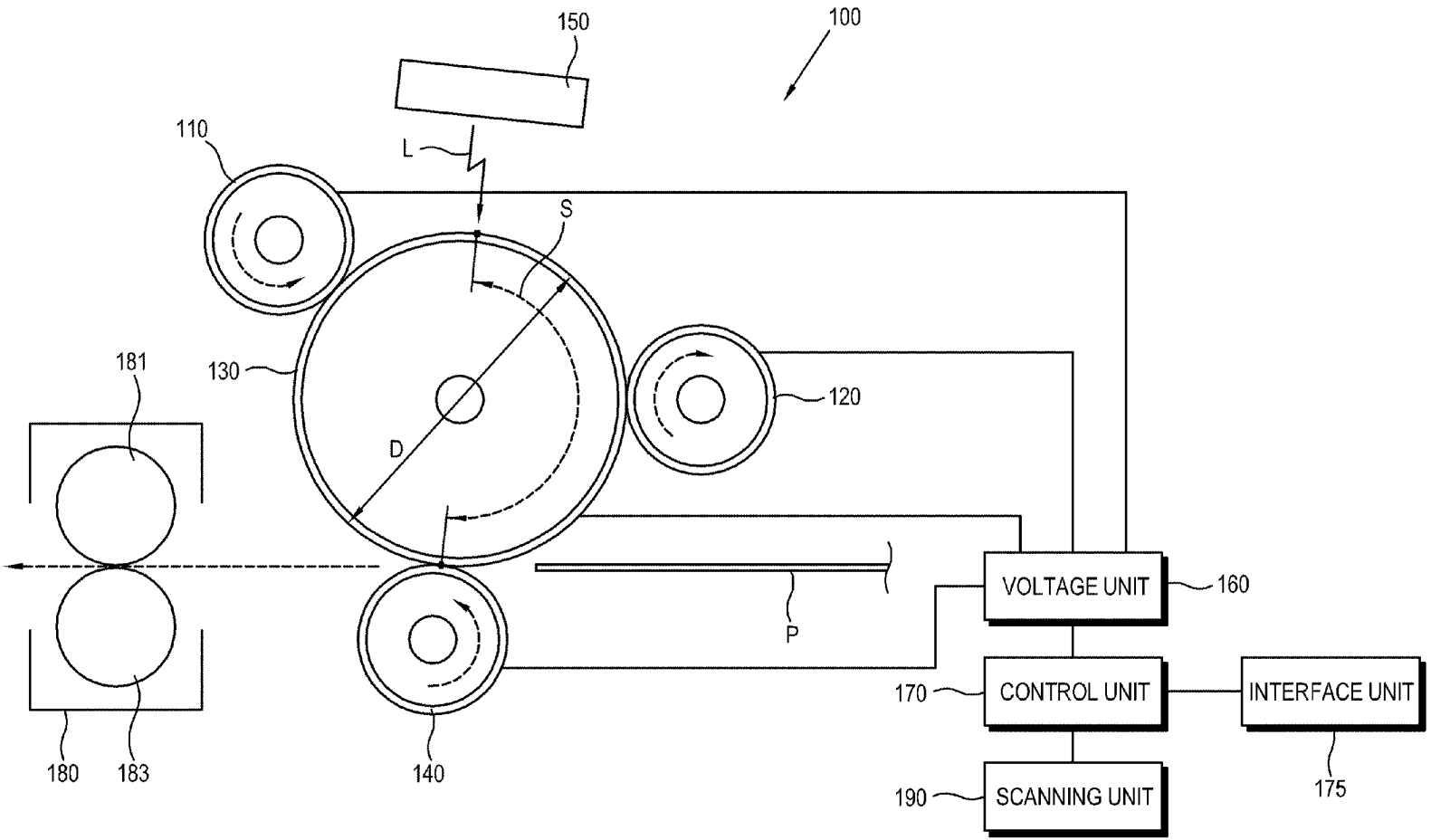
FIG. 4 is a schematic view of an image forming apparatus 100 according to an embodiment of the present general inventive concept.

As shown in FIG. 4, an image forming apparatus according to an exemplary embodiment of the present general inventive concept includes an image carrying body 130, a charging unit 110, a light exposing unit 150, a developing unit 120, a transferring unit 140, a voltage unit 160 and a control unit 170.

The charging unit 110 may receive a charging voltage from the voltage unit 160, and charges the image carrying body 130 to have a predetermined surface electric potential. As shown in FIG. 4, the charging unit 110 may be a charging roller 110 of a contact charging type. Alternatively, a corona charger of a non contact type may be employed thereto. Here, the predetermined surface electric potential may be approximately −700V.

The light exposing unit 150 may receive a light exposing signal corresponding to printing data from the control unit 170, and exposes the charged image carrying body 130. Accordingly, an electrostatic latent image corresponding to the printing data is formed on a surface of the image carrying body 130. The surface electric potential of the exposed part may be changed to approximately −150V, and the surface electric potential of a non-exposed part may still have a voltage of −700V which is charged by the charging unit 110.

The light exposing unit 150 may include at least one of a laser scanning unit (LSU) scanning a laser light, and an light emitting diode (LED) array having LEDs arranged in a lengthwise direction of the image carrying body 130.

The developing unit 120 may receive a developing voltage from the voltage unit 160 to have a voltage of approximately −500V within a range between −150V and −700V. Accordingly, a developer having a negative charge around the developing unit 120 may be applied to an exposed portion in which an electrostatic repulsive force is minimized, and a visible image configured with the developer and corresponding to the printing data is formed on the surface of the image carrying body 130. Here, the developing unit 120 is illustrated as a roller type in FIG. 4. However, the developing unit 120 is not defined thereto, and alternatively, other known types may be applied thereto.

The transferring unit 140 may receive a transferring voltage from the voltage unit 160, and transfers the visible image to a printing medium P by an electric attractive force.

The visible image may be transferred to the printing medium P from a transferring area A between the transferring unit 140 and the image carrying body 130, in which an electric field is formed. As shown in FIG. 4, in case of a direct transferring type that the image carrying body 130 and the transferring unit 140 contact each other to perform transferring, the transferring is performed in a transferring nip A.

As shown in FIG. 4, the transferring unit 140 is illustrated as a roller type. Alternatively, the transferring unit 140 may be implemented as a belt type as necessary. In this case, the visible image may be transferred to a belt (transferring belt) of the transferring unit 140 instead of the printing medium, and the visible image on the belt may be transferred again on the printing medium. This type is mainly employed to an image forming apparatus of a multi path type.

Accordingly, the printing medium or the transferring belt may be a transferring target body to which the developer visible image of the image carrying body 130 is transferred by the transferring unit 140.

The visible image formed of the developer transferred to the printing medium P may pass through a fusing unit 180, and may be fused on the printing medium P by a heat and a pressure of a heating roller 183 and a pressing roller 181.

The voltage unit 160 may respectively apply the charging voltage, the developing voltage and the transferring voltage to the charging unit 110, the developing unit 120 and the transferring unit 140. The transferring voltage may be classified into a first transferring voltage, and a second transferring voltage different from the first transferring voltage.

The control unit 170 may control the voltage unit 160 to apply the first transferring voltage and the second transferring voltage to the transferring unit 140 based on the density of the developer in a unit section of the surface of the image carrying body 130.

The unit section may be arbitrarily selected, or may be selected to be within approximately 1 mm to 10 mm. The unit section may be approximately 5 mm. If the unit section is excessively short, a lot of load is applied to the image forming apparatus 100, but if the unit section is excessively long, it is difficult to find a point of time for applying the second transferring voltage. Accordingly, the unit section may be determined appropriately by experiment or experience.

More specifically, the control unit 170 may calculate the density of the developer or the amount of the developer in a unit section Δs of the surface of the image carrying body 130. This unit section is capable of being calculated out of printing data to be printed or a light exposing signal of the light exposing unit 150. Since it can be assumed that the image carrying body 130 rotates with a uniform speed and a transportation speed of the printing medium is uniform, the unit section Δs of the image carrying body 130 may be converted into a unit time corresponding thereto. Accordingly, the density of the developer in the unit section Δs may be converted into a concept of a developer density during a unit time.

The printing data may be obtained by scanning an image on a document by a scanning unit 190, or may be supplied from an external host apparatus (not shown) through an interface unit 175. Also, binary data of '0' and '1' may be converted into bitmap image data by the control unit 170, or bitmap image data may be directly supplied from the host apparatus. The bitmap image data includes data about a blank area (dot) and a printing area (dot) in a dot unit. In detail, '0' may be defined as a non light exposing area which is a blank area being not applied with the developer, and '1' may be defined as a light exposing area to which the developer is applied. Alternatively, they may be defined oppositely as necessary.

The interface unit 175 may be used for connecting with an external host apparatus (not shown), and may include at least one of a network interface card, a serial port, a parallel port and a universal serial bus (USB) port.

Also, the scanning unit 190 may include at least one of a charge coupled device (CCD) sensor and a contact image sensor (CIS).

The light exposing signal is a signal generated by the control unit 170 based on the bitmap image data, and is a pulse signal for turning on and off an LED (not shown) provided to the light exposing unit 150.

Accordingly, the control unit 170 may be capable of calculating the density of the developer in the unit section Δs by using the bitmap image data itself and counting the number of developer dots (the number of '1's) to be applied in the unit section Δs of the image carrying body 130, or by using the light exposing signal and counting the number of exposed dots (the number of 'on' pulses) in the unit section Δs of the image carrying body 130.

Here, the amount of the developer in the unit section Δs may be calculated by counting the number of the developer dots. Also, the unit thereof may be a dot, or a weight (gram) which is converted from the dot.

The developer density in the unit section Δs may be calculated as the ratio of the number of dots to which the developer in the unit section Δs is to be applied to the number of total dots in the unit section Δs. That is, it may be calculated as the following Equation 1.

$$\text{developer density in unit section (\%)} = \frac{\text{number of dot applied with developer in unit section}}{\text{number of total dot in unit section}} \quad \text{[Equation 1]}$$

Like the Equation 1, since the developer density (%) in the unit section and the developer amount (the number applied with the developer) in the unit section have different units, but are in a proportional relation with each other, it is sufficient to calculate only one of them. Also, a first reference value, a second reference value and a density gap which will be compared with the developer density may be calculated by being multiplied by the number of total dots in the unit section Δs if the developer amount is calculated instead of the developer density. For example, the density gap multiplied by the number of total dots in the unit section Δs is the amount of gap, and this may be compared with the calculated developer amount.

Accordingly, the developer density becomes 100% if dots in the unit section Δs of the image carrying body 130 are totally exposed and applied with the developer, and becomes 0% if the total area of the unit section Δs is not exposed.

The control unit 170 may calculate the developer density (or the developer amount by each unit section Δs of the image carrying body 130. In the calculation result, if a first developer density in a specific unit section, that is, a first unit section ΔY is larger than the first reference value, the control unit 170 controls the voltage unit 160 to apply the second transferring voltage to the transferring unit 140 while the first unit section ΔY passes through the transferring area A.

That the first developer density in the first unit section ΔY is larger than the first reference value means that a relatively deep black image is formed in the first unit section ΔY. For this, the first reference value is sufficient to belong to 51%~99% in theory. The first reference value may be arbitrarily selected within the range of 60%~80%, or may be found to be appropriate to each image forming apparatus 100 through experiment or experience.

Also, the second transferring voltage may be larger than the first transferring voltage.

Also, the control unit 170 may control the voltage unit 160 to apply the first transferring voltage in the remaining case except a case applying the second transferring voltage.

For example, when the first transferring voltage of approximately +1,000V is applied to the transferring unit 140, the control unit 170 controls the voltage unit 160 to change the first transferring voltage and to apply the second transferring voltage of 1,400V which is larger than the first transferring voltage to the transferring unit 140 if the first unit section ΔY enters the transferring area A.

As necessary, the control unit 170 may control the voltage unit 160 to additionally apply a third transferring voltage after applying the first transferring voltage and the second transferring voltage. Here, the level of the third transferring voltage may be the same as that of the first transferring voltage, or different therefrom.

The control unit 170 described above may apply the second transferring voltage if the first developer density (or the first developer amount) in the first unit section ΔY is larger than the first reference value. Hereinafter, other conditions for applying the second transferring voltage will be described.

The control unit 170 may compare a first developer density (or a first developer amount) of a specific unit section, that is, a first unit section ΔY with a second developer density (or a second developer amount) of a second unit section ΔX, and control the voltage unit 160 to change the transferring voltage from a first transferring voltage to a second transferring voltage depending on a comparing result thereof.

More specifically, if a difference between the first developer density (or the first developer amount) and the second developer density (or the second developer amount) is larger than a predetermined density gap (or an amount gap), the control unit 170 may control the voltage unit 160 to apply the second transferring voltage to the transferring unit 140 while the first unit section ΔY passes through the transferring area A.

Figure 6:
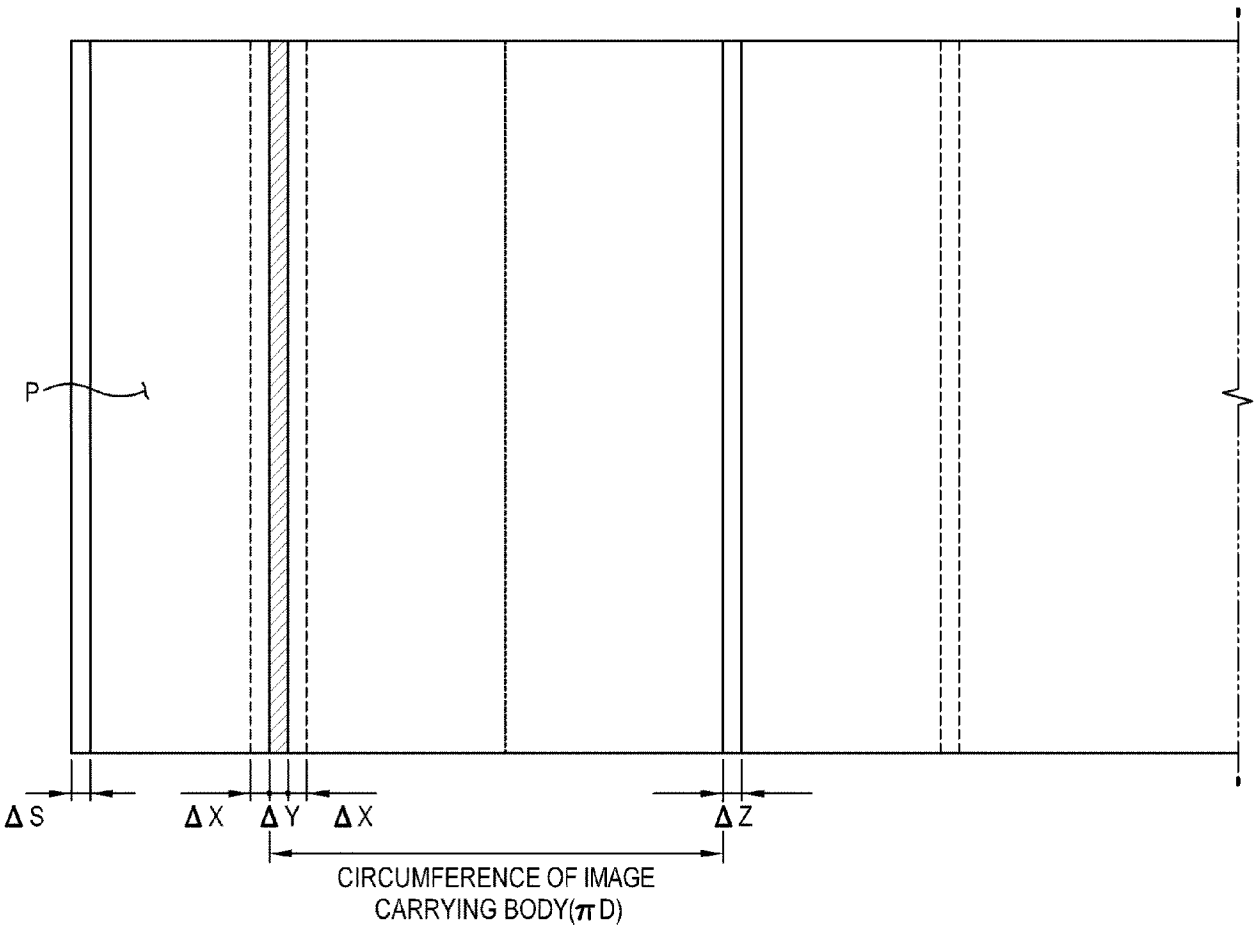
FIG. 6 illustrates a disposition relation between a first unit section and a second unit section on a surface of an image carrying body of the image forming apparatus 100 in FIG. 4.

FIG. 6 illustrates correspondence between the unit section of the image carrying body 130 according to rotation of the image carrying body 130 and the printing medium P.

As shown in FIG. 6, the first unit section ΔY and the second unit section ΔX may be vicinal to each other on the printing medium P or the image carrying body 130. That is, the second transferring voltage may be applied to the transferring unit 140 while the first unit section ΔY passes through the transferring area A if developer densities of the first unit section ΔY and the vicinal second unit section ΔX are compared and the difference thereof is determined to be larger than the density gap.

Figure 2:
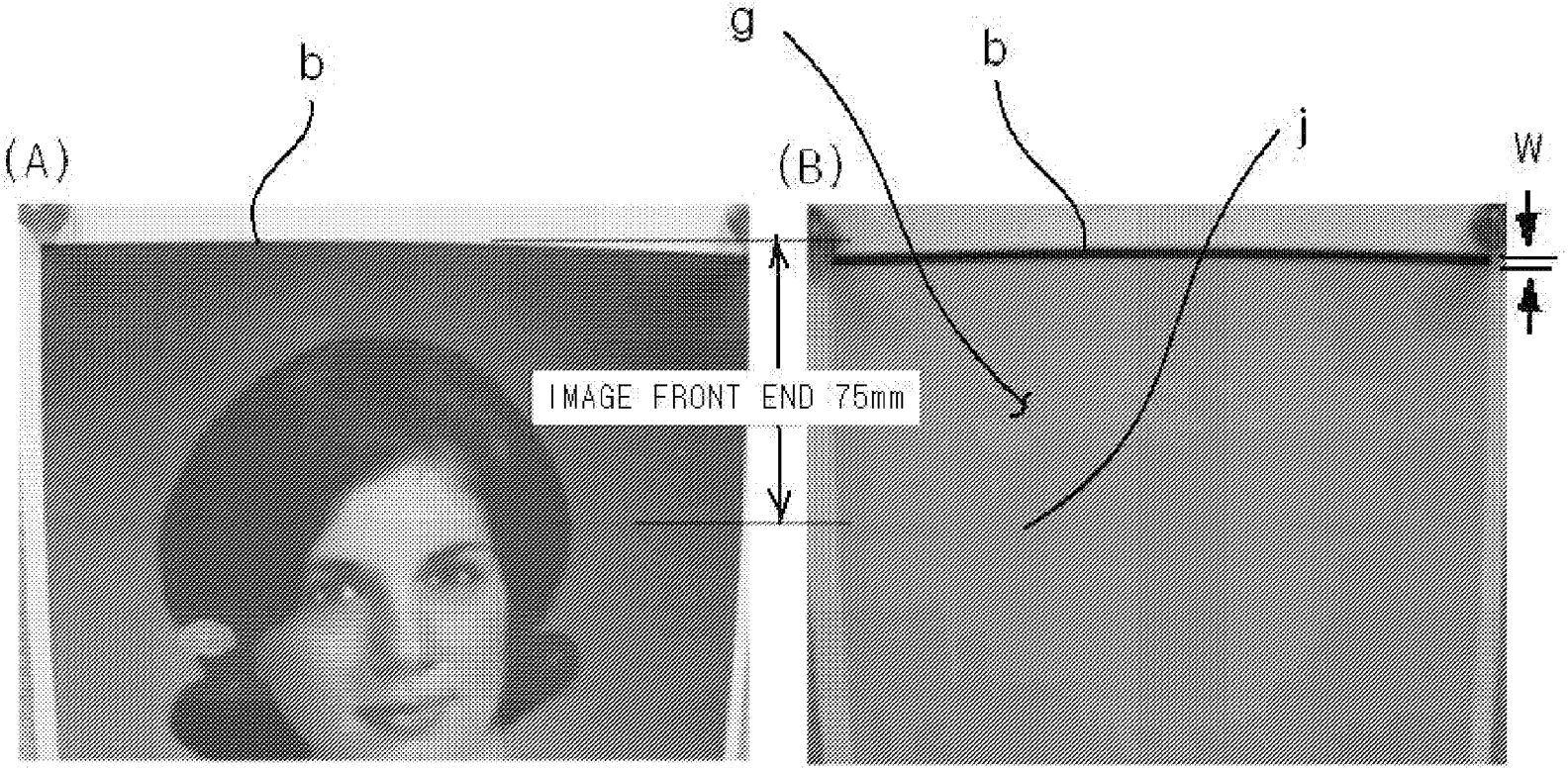
FIGS. 2A and 2B are photographs taking output results outputted by using the conventional image forming apparatus.
Figure 3A:
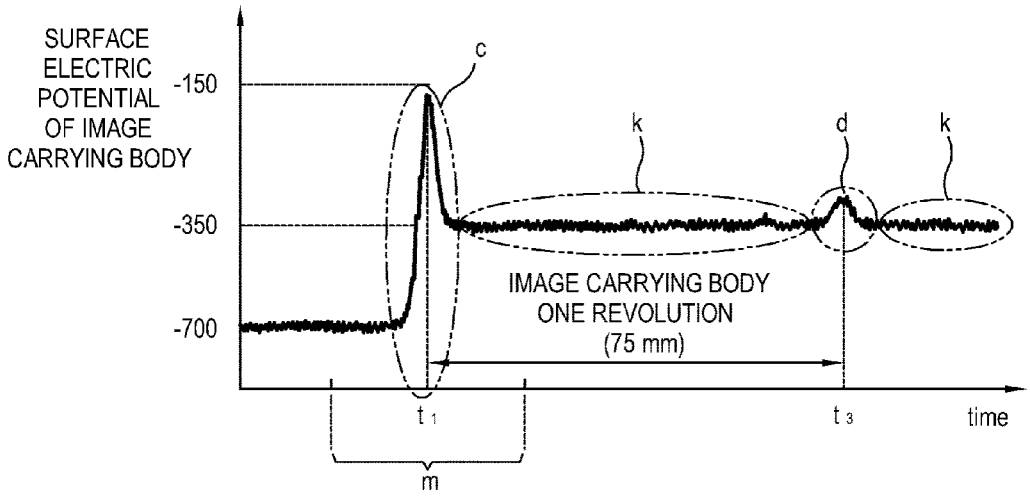
FIG. 3A is an actual measuring graph of a surface electric potential according to time of an image carrying body 13 of the image forming apparatus 1 in FIG. 1 when an image in FIG. 2B is printed by using the conventional image forming apparatus 1.

As described above, since the stripe j shown in FIGS. 2A and 2B and the image ghost may be caused if there exists the potential difference rapid change section m as shown in FIG. 3A, the difference of the developer density is compared to find the potential difference rapid change section m in FIG. 3A. More specifically, if the developer density difference between the first unit section ΔY and the vicinal second unit section ΔX is larger than the density gap, the potential difference rapid change section m in FIG. 3A may be determined to exist.

For example, if the developer density of the first unit section ΔY is 90% and the developer density of the second unit section ΔX is 10% and the density gap is 30%, then the developer density difference therebetween is 80% and larger than the density gap 30%, which is determined as the potential difference rapid change section m for applying the second transferring voltage. With this example, the developer density is a value corresponding to an average electric potential of the image carrying body 130 in the corresponding unit section, and the ghost image is apt to occur if the developer density difference is 80% and if the potential difference between the two sections is approximately 470V.

Accordingly, when the first unit section ΔY enters the transferring area A, inequality of the potential difference may be relieved by applying the second transferring voltage larger than the existing first transferring voltage to the transferring unit 140, thereby preventing the image ghost.

Figure 5A:
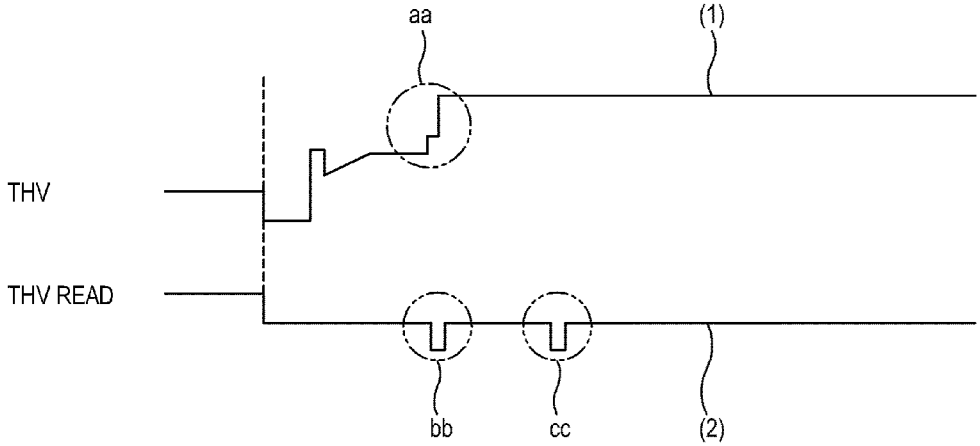
FIG. 5A is a timing diagram of a transferring voltage THV applied to the transferring unit 14 and a feedback voltage THV_READ of the transferring unit 14 of the image forming apparatus 1 in FIG. 1.
Figure 5B:
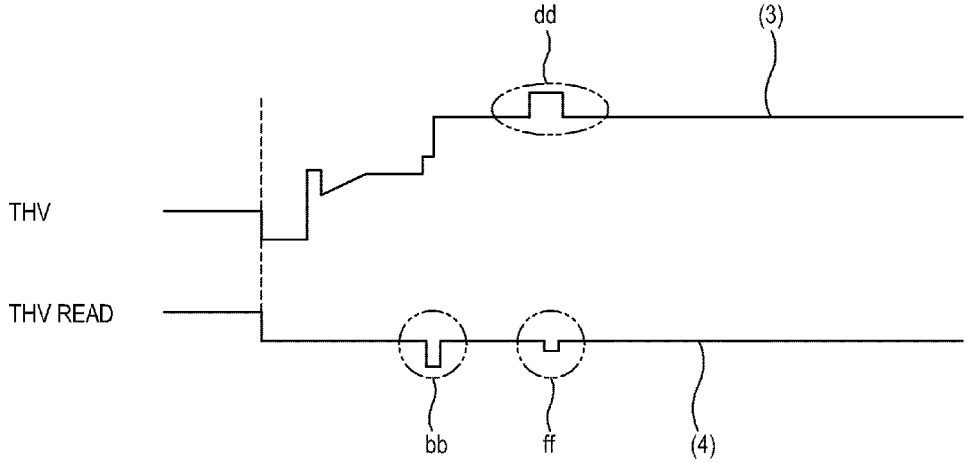
FIG. 5B is a timing diagram of a transferring voltage THV applied to a transferring unit 140 and a feedback voltage THV_READ of the transferring unit 140 of the image forming apparatus 100 in FIG. 4.

Elements (1) and (2) in FIG. 5A are respectively timing diagrams of a transferring voltage THV applied to the transferring unit 14 of the conventional image forming apparatus 1 and a feedback voltage THV_READ of the transferring unit 14, and elements (3) and (4) in FIG. 5B are respectively timing diagrams of a transferring voltage THV applied to the transferring unit 140 of the image forming apparatus 100 according to an exemplary embodiment of the present general inventive concept and a feedback voltage THV_READ of the transferring unit 140.

Figure 3B:
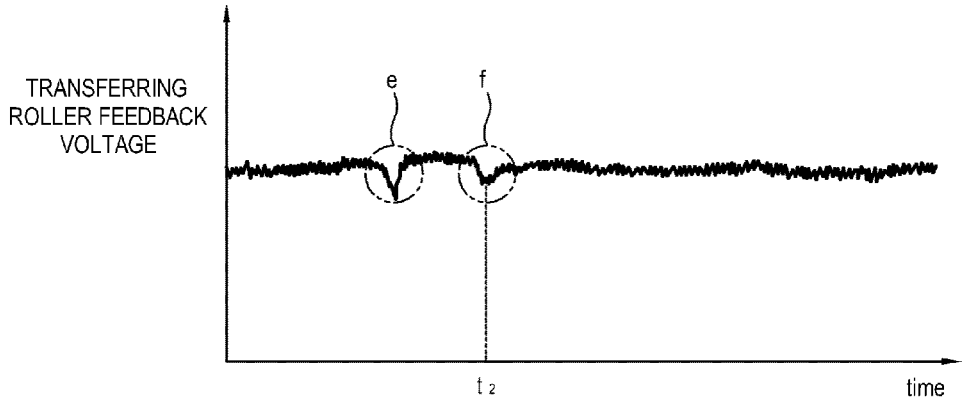
FIG. 3B is an actual measuring graph of a feedback voltage according to time of a transferring roller 14 when the image in FIG. 2B is printed by using the conventional image forming apparatus 1.
Figure 3C:
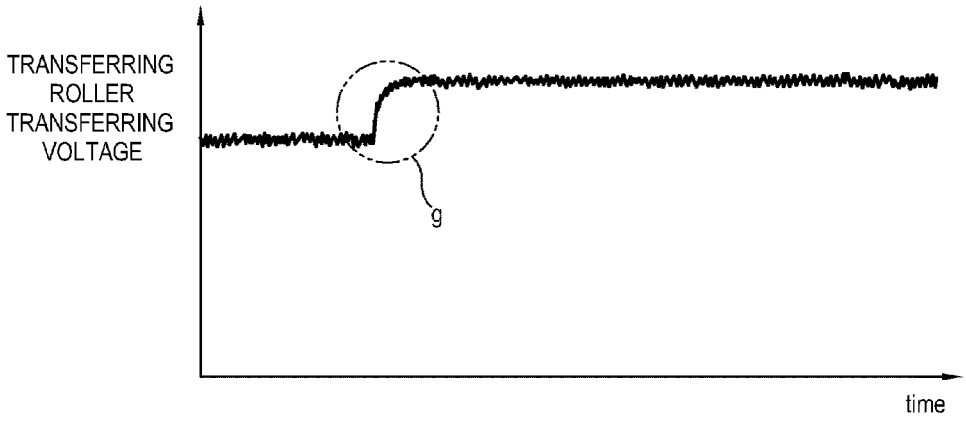
FIG. 3C is an actual measuring graph of a transferring voltage according to time of the transferring roller 14 when the image in FIG. 2B is printed by using the conventional image forming apparatus 1.

In element (2) of FIG. 5A, a feedback voltage decreases in areas bb and cc. The area bb corresponds to e in FIG. 3B, and is generated according to a point of time in which the printing medium P passes between the image carrying body 13 in FIG. 1 and the transferring roller 14 in FIG. 1, that is, the transferring nip N in FIG. 1. Also, the area cc corresponds to f in FIG. 3B, and is generated as the above potential difference rapid change section m in FIG. 3A enters between the image carrying body 13 in FIG. 1 and the transferring roller 14 in FIG. 1.

As shown in element (1) of FIG. 5A, the conventional transferring voltage THV increases (referring to aa) only when the printing medium enters, and the transferring voltage is not changed and shows uniformity although the potential difference rapid change section m in FIG. 3A passes. Accordingly, as describe above, although the potential difference rapid change section m in FIG. 3A passes through the charging unit 11 in FIG. 1, the potential difference just decreases and the effect thereof still remains so that the image ghost j in FIGS. 2A and 2B may be generated.

However, in the image forming apparatus 100 according to present embodiment, as shown in (3) of FIG. 5B, if the printing medium P enters the transferring nip A in FIG. 4 (referring to area bb in FIG. 5B), the transferring voltage applied to the transferring unit 140 increases to the first transferring voltage, and the first transferring voltage is maintained. Then, if there exists the first unit section ΔY and the vicinal second unit section ΔX, the developer density difference of which is larger than the density gap, that is, if there exists the potential difference rapid change section m in FIG. 3A, the first transferring voltage is converted to the second transferring voltage (referring to area dd in FIG. 5B) when the first unit section ΔY enters the transferring area, that is the transferring nip A in FIG. 4. Accordingly, by applying the second transferring voltage larger than the first transferring voltage, the rapid potential difference between the first unit section ΔY and the vicinal second unit section ΔX is partially offset by the second transferring voltage, and the potential difference may be reduced. This is capable of being appreciated from an aspect that the amount of voltage decrease of the transferring voltage feedback voltage significantly decreases in comparison to the conventional when area ff of the feedback voltage THV_READ diagram of the transferring unit 140 and the area cc of (2) in FIG. 5A of the conventional are compared each other.

The point in time in which the first transferring voltage is changed to the second transferring voltage is not necessary to accord to the point in time in which the first unit section ΔY enters the transferring nip A in FIG. 4, and some time difference may be allowable therebetween.

The control unit 170 may compare the first developer density and the second developer density and apply the second transferring voltage in a case that the first unit section ΔY and the second unit section ΔX are adjacent to each other. Hereinafter, a condition with which the second transferring voltage is capable of being applied although the second unit section ΔX is not vicinal will be described.

As shown in FIG. 6, a second unit section ΔZ is displayed as an image area distanced by the circumference of the image carrying body 130 with respect to the first unit section ΔY on the printing medium P. That is, in a standpoint of the image carrying body 130, the first unit section ΔY and the second unit section ΔZ are the same sections exposed with a time interval during one revolution of the image carrying body 130.

As shown in FIG. 3A, the image ghost j in FIGS. 2A and 2B apparently may appear if an area of the image carrying body 13 formed with a deep black image rotates one revolution and a gray color image is formed to the area of the image carrying body 13 formed with the deep black image.

Accordingly, the condition with which the image ghost j in FIGS. 2A and 2B is apt to appear is as follows.

As shown in FIGS. 4 and 6, the above image ghost j in FIGS. 2A and 2B is apt to appear if a first developer density of the surface of the image carrying body 130 is larger than the first reference value (meaning that a black image which is deep by the first unit section ΔY on the image carrying body 130 is formed), and the difference between a second developer density of the second unit section ΔZ in a position distanced by the circumference of the image carrying body 130 and the first developer density is larger than a predetermined density gap. This is a case that a value subtracted by the second developer density from the first developer density is larger than the predetermined density gap.

For example, if the first developer density is 80%, the second developer density is 20%, and a predetermined density gap is 50%, then the value subtracted by the second developer density from the firs developer density is 60%, which is larger than the density gap 50%, which corresponds to the condition in which the image ghost j in FIGS. 2A and 2B is apt to be visible to the naked eye.

If this condition happens, that is, the difference between the first developer density and the second developer density is larger than a predetermined density gap, the control unit 170 may control the voltage unit 160 to apply the second transferring voltage to the transferring unit 140 while the first unit section ΔY passes through the transferring area A.

Whether to apply the second transferring voltage may be determined according whether the difference between the first developer density and the second developer density is larger than the predetermined density gap or not. Alternatively, the control unit 170 may control the voltage unit 160 to apply the second transferring voltage to the transferring unit 140 if the first developer density is larger than the first reference value, and the second developer density is smaller than the second reference value.

Also, the conditions for applying the second transferring voltage may be mixed with an AND condition. More specifically, the control unit 170 may control the voltage unit 160 to apply the second transferring voltage to the transferring unit 140 if the first developer density is larger than the first reference value and the second developer density is smaller than the second reference value, and the difference between the first developer density and the second developer density is larger than a predetermined density gap.

A variation voltage (ΔV=V2−V1) between the second transferring voltage V2 and the first transferring voltage V1 may be variously provided depending on temperature, humidity and the density gap as shown in the following Table 1.

As the density gap (or the amount gap) increases, that is, the surface potential difference between the first unit section ΔY and the second unit section ΔX and ΔZ increases, the second transferring voltage V2 increases because it is preferable to apply a larger transferring voltage to offset the surface potential difference as the surface potential difference increases.

Also, HH, NN and LL in Table 1 respectively indicate an environment of the image forming apparatus 100 comprising of a case of a high temperature (more than 30° C.) and a high humidity (80%), a case of a normal temperature (10° C.~30° C.) and a middle humidity (20%~80%), and a case of a low temperature (less than 10° C.) and a low humidity (less than 20%).

The second transferring voltage may be stored in a look up table in a memory (not shown) to have varying levels depending on the temperature, humidity, and density gap as shown in Table 1 above. Also, the control unit 170 may find the value of the second transferring voltage corresponding to the sensed temperature, humidity, and density gap through the look up table.

As described in Table 1, as the temperature and humidity of an external environment decrease, that is, as it goes from the condition HH to the condition LL, the second transferring voltage increases.

Thus, the second transferring voltage may be in inverse proportion to the temperature and humidity.

To sense the temperature and humidity around the image forming apparatus 100, a separate temperature sensor and humidity sensor may be provided. However, since the transferring unit 140 is most sensitive to the temperature and humidity among internal components of the image forming apparatus 100, by applying a test voltage to the transferring unit 140 and measuring a resistance thereof, the temperature and humidity may be indirectly measured from the resistance.

The following Table 2 is an evaluating table comparing to the naked eye outputs of the same black image printed by using the conventional image forming apparatus 1 and the image forming apparatus 100 according to an exemplary embodiment of the present general inventive concept. More specifically, in an external environment of the condition 'LL', a first unit section and a second unit section are vicinal to each other, and outputs are evaluate(d to the naked eye as the developer density difference therebetween varies from 0% to 99%.

TABLE 1

| | | density gap (amount gap) (%) | | | | | | | | | | |
|---|---|---|---|---|---|---|---|---|---|---|---|---|
| | | 0 | 10 | 20 | 30 | 40 | 50 | 60 | 70 | 80 | 90 | 99 |
| ΔV | HH | 0 | 0 | 0 | 0 | 0 | 0 | 50 | 100 | 150 | 200 | 200 |
| (volt) | NN | 0 | 0 | 0 | 0 | 0 | 100 | 200 | 300 | 300 | 400 | 500 |
| | LL | 0 | 0 | 0 | 300 | 300 | 600 | 600 | 700 | 800 | 900 | 1000 |

TABLE 2

| | | density gap (amount gap) (%) | | | | | | | | | | |
|---|---|---|---|---|---|---|---|---|---|---|---|---|
| | | 0 | 10 | 20 | 30 | 40 | 50 | 60 | 70 | 80 | 90 | 99 |
| image forming apparatus 1 | image ghost rank | 4 | 4 | 4 | 3 | 3 | 2 | 2 | 2 | 1 | 1 | 1 |
| | eye evaluation | OK | OK | OK | OK | OK | NG | NG | NG | NG | NG | NG |
| image forming apparatus 100 | variation voltage (ΔV) | 0 | 0 | 0 | 300 | 300 | 600 | 600 | 700 | 800 | 900 | 1000 |
| | image ghost rank | 4 | 4 | 4 | 4 | 4 | 4 | 4 | 4 | 3 | 3 | 3 |

In Table 2, the image ghost ranks 4, 3, 2, and 1 and respectively represent a case that there is no image ghost, a case that the image ghost is normal, a case that the image ghost is intense, and a case that the image ghost is excessively intense. Also, the ranks 4 and 3 are evaluated to be good (OK) in the eye evaluation, and the ranks 2 and 1 are evaluated not to be good (NG).

As shown in Table 2, when the image ghost rank is compared, it is appreciated that the image ghost disappears or the intense image ghost is enhanced in the image forming apparatus 100 according to the present general inventive concept in comparison to the conventional image forming apparatus.

Figure 7:
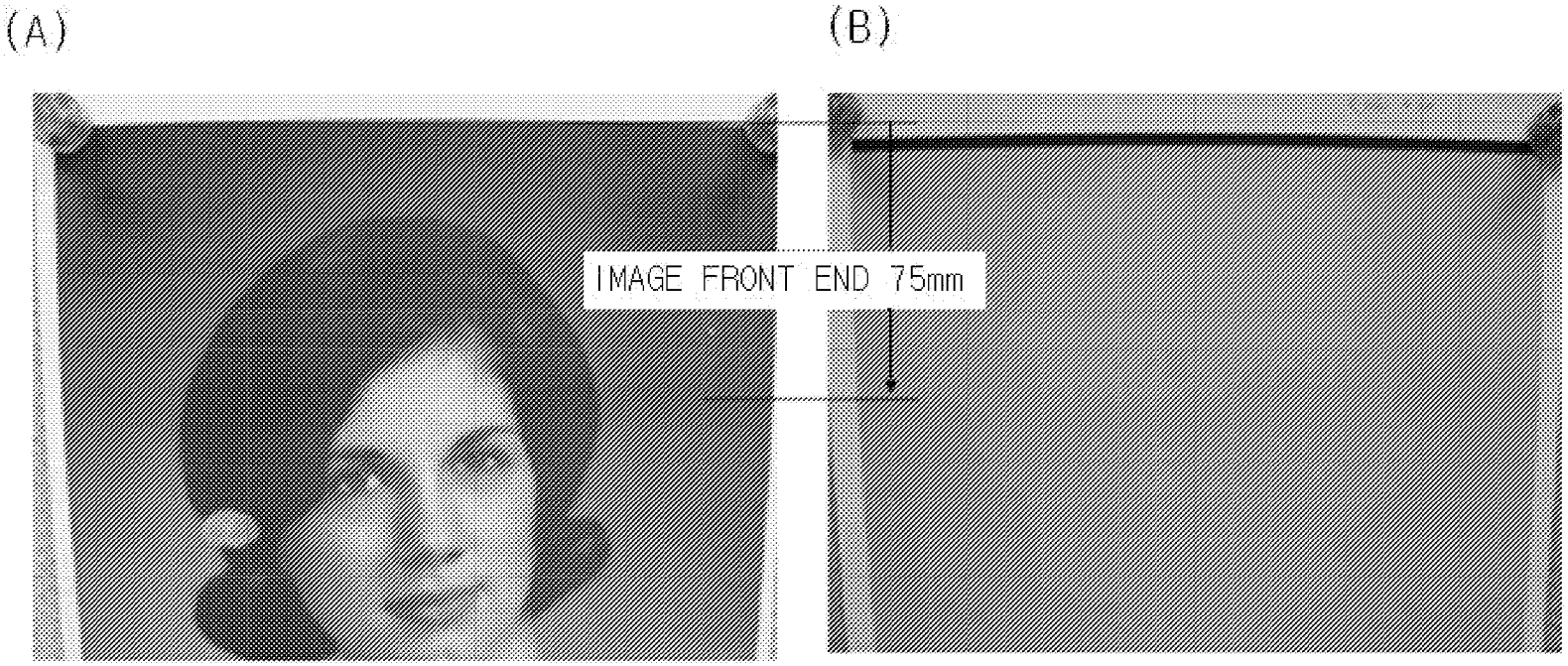
FIGS. 7A and 7B are photographs of outputs from the same images as FIGS. 2A and 2B by using the image forming apparatus 100 in FIG. 4.

FIGS. 7A and 7B illustrate printing outputs of the same images as FIGS. 2A and 2B printed by the image forming apparatus 100 according to an exemplary embodiment of the present general inventive concept.

As shown in FIGS. 7A and 7B, the stripe j visible to the naked eye in FIGS. 2A and 2B, that is, the image ghost is invisible in FIGS. 7A and 7B.

Accordingly, a printing image quality may be improved by the image forming apparatus according to an exemplary embodiment of the present general inventive concept out of the output results of the same images.

Also, the image ghost may be removed in case of using a charge remover to remove an electrostatic remaining on the image carrying body after transferring the potential difference rapid change section m in FIG. 3A. However, the present general inventive concept may obtain a similar effect as the case of disposing the charge remover without additionally disposing the charge remover, thereby improving a space efficiency and making a smaller product.

Also, the charge remover is not used, thereby reducing manufacturing cost.

Hereinafter, a control method of the image forming apparatus 100 according to exemplary embodiments of the present general inventive concept and a changing process of a transferring voltage for the transferring unit 140 in FIG. 4 will be described by referring to FIGS. 4 and 8 to 12.

Figure 8:
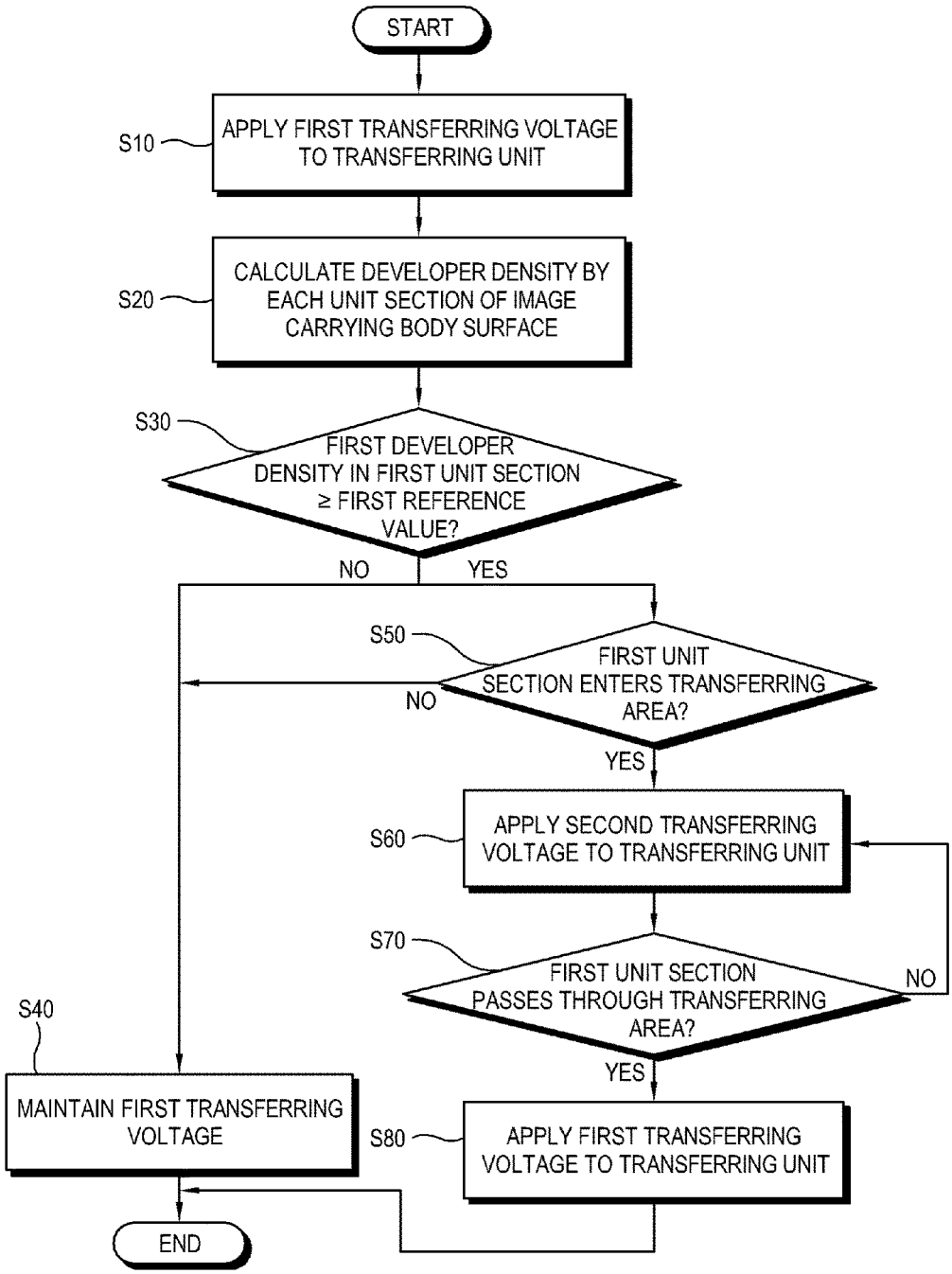
FIG. 8 is a flowchart of a control method of an image forming apparatus according to another exemplary embodiment of the present general inventive concept.

As shown in FIG. 8, a control method of the image forming apparatus 100 according to a first exemplary embodiment may apply a first transferring voltage to the transferring unit 140 (operation, S10).

Then, a developer density by each unit section on a surface of the image carrying body 130 may be calculated (operation, S20). As described above, the developer density may be replaced by a developer amount which is only different in dimension but is in direct proportion thereto. Also order of the operations S10 and S20 may be changed.

Then, a first developer density in a first unit section ΔY may be determined to be larger than a first reference value (operation, S30). Here, the first reference value may be predetermined, or inputted from a user. That is, if the first developer density in the first unit section ΔY is larger than the first reference value, the first unit section ΔY is a section in which a deep black image is formed in printing a black image. Further, when the first unit section ΔY is exposed by the light exposing unit 150, the surface electric potential thereof begins to have a substantially large electric potential (small in the absolute value, for example, −200V), and the first unit section ΔY begins to have a substantial potential difference from a surface electric potential (for example, −700V) charged by the charging unit 110. In this case, a first reference value amended with the same dimension as a first developer amount may be used for comparison instead of the first developer density. That is, the first developer amount in the first unit section ΔY may be determined to be larger than the first reference value.

In case of being smaller than the first reference value (NO of operation S30), the first transferring voltage may be maintained and continually applied to the transferring unit 140 (operation, S40).

If the first developer density is larger than the first reference value (YES of operation S30), it is determined whether the first unit section ΔY on the surface of the image carrying body 130 enters a transferring area A or not (operation, S50).

If the first unit section ΔY enters the transferring area A (YES of operation S50), the second transferring voltage may be applied to the transferring unit 140 instead of the first transferring voltage (operation, S60).

Then, it is determined whether the first unit section ΔY completely passes through the transferring area A (operation, S70).

Before passing through the transferring area (NO of operation S70), the second transferring voltage may be continually applied to the transferring unit 140 (operation, S60).

If the first unit section ΔY passes through the transferring area A (YES of operation S70), the first transferring voltage may be applied to the transferring unit 140 again (operation, S80).

Accordingly, by applying the second transferring voltage larger than the first transferring voltage when the first unit section, which has a large potential difference from the surface electric potential charged by the charging unit 110 because the first developer density is large, passes through the transferring area A, it may be reveiled that the surface electric potential of the image carrying body 130 is rapidly changed around the first unit section. Accordingly, the image ghost may be prevented from happening.

Figure 9:
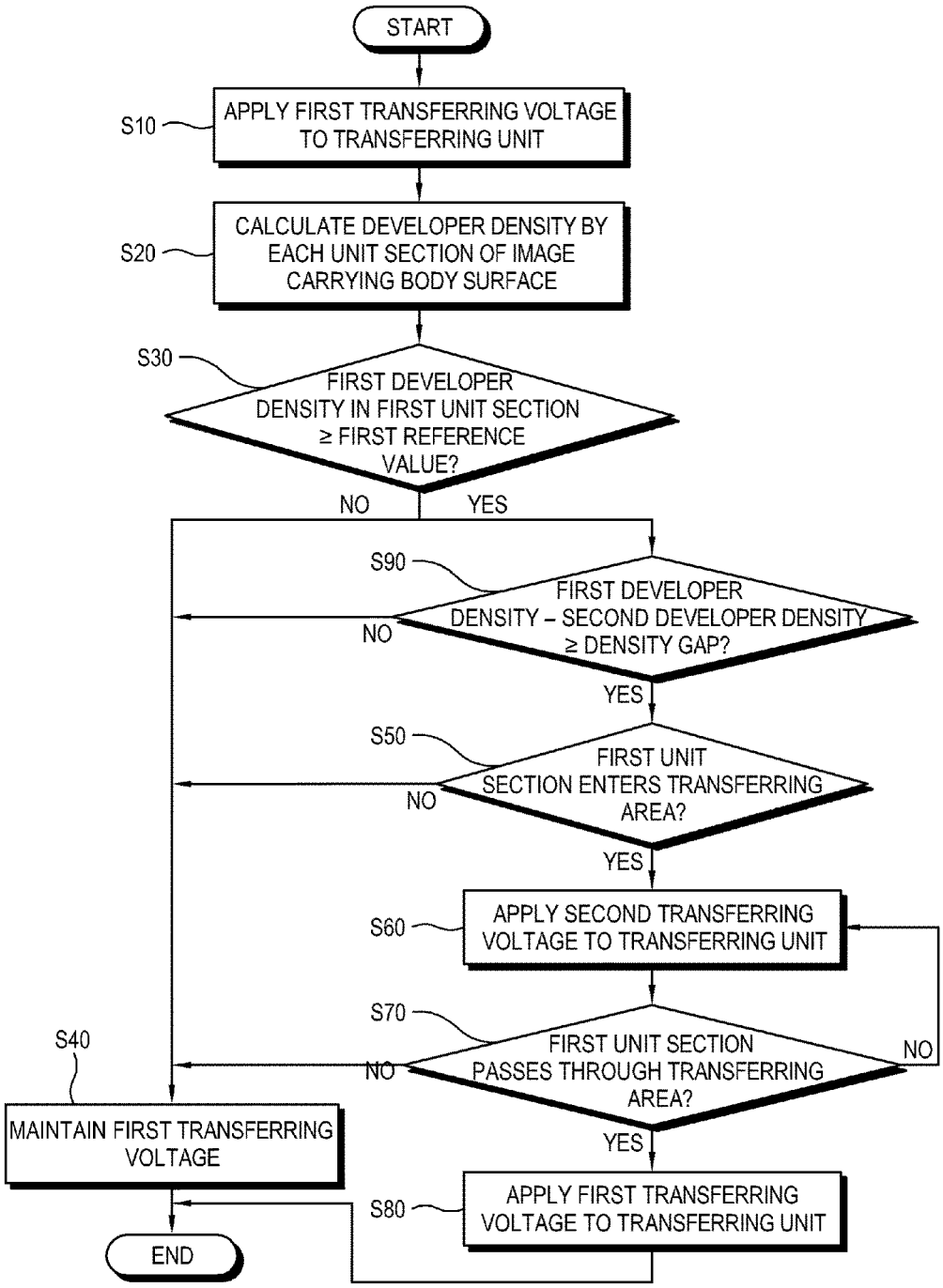
FIG. 9 is a flowchart of a control method of an image forming apparatus according to another exemplary embodiment of the present general inventive concept.

Hereinafter, a control method of an image forming apparatus according to another exemplary embodiment of the present general inventive concept will be described by referring to FIG. 9.

In comparison to the control method of the image forming apparatus according to the first exemplary embodiment, an operation S90 may be added to determine a point of time applying the second transferring voltage between the operations S30 and S50.

That is, if the first developer density in the first unit section ΔY is larger than the first reference value (YES of operation S30), then it is determined whether the difference between the first developer density and a second developer density in a second unit section is larger than a predetermined density gap (operation, S90).

If the difference between the first developer density and the second developer density is larger than the predetermined density gap (YES of operation S90), and the first unit section ΔY enters the transferring area (YES of operation S50), the second transferring voltage is applied to the transferring unit 140 (operation, S60). The remaining operations may be the same as the first exemplary embodiment.

Hereinafter, a control method of an image forming apparatus according to another exemplary embodiment of the present general inventive concept will be described by referring to FIG. 10.

In the control method of the image forming apparatus according to the third exemplary embodiment, an operation S100 is added between the operations S30 and S50 in comparison to the first exemplary embodiment, and an operation S100 replaces the operation S90 in comparison to the other exemplary embodiment.

That is, if the first developer density in the first unit section ΔY is larger than the first reference value (YES of operation S30), then it is determined whether the second developer density in the second unit section ΔX and ΔZ is smaller than the second reference value (operation, S100).

If the second developer density is smaller than the second reference value (YES of operation S100), and the first unit section ΔY enters the transferring area (YES of operation S50), the second transferring voltage may be applied to the transferring unit 140 instead of the first transferring voltage (operation, S60).

Figure 10:
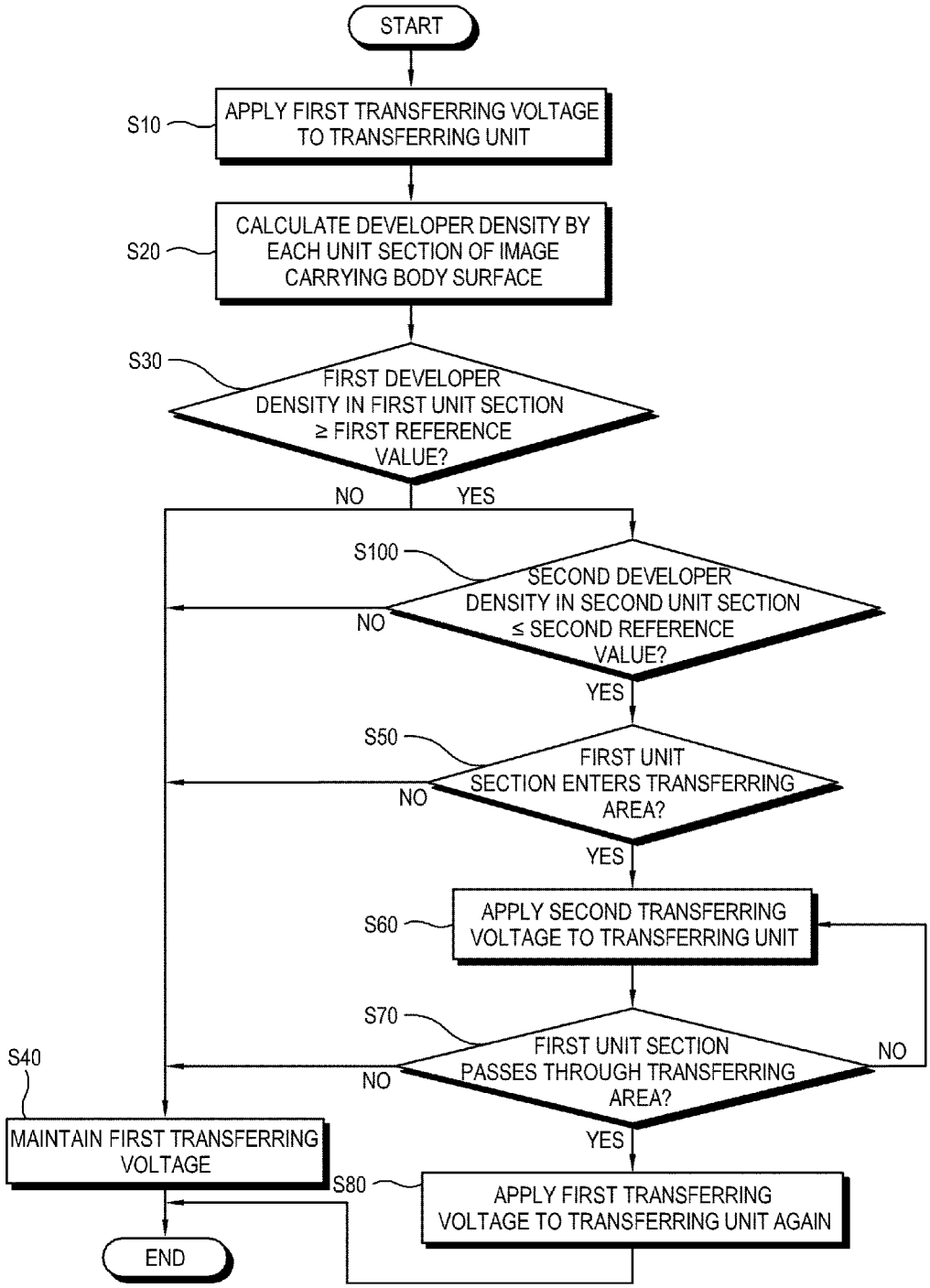
FIG. 10 is a flowchart of a control method of an image forming apparatus according to another exemplary embodiment of the present general inventive concept.

In the case of FIG. 10, the first unit section ΔY and the second unit section ΔX in FIG. 6 may be vicinal to each other on the image carrying body 130 or the printing medium P.

Also, the second unit section ΔZ in FIG. 6 and the first unit section ΔY in FIG. 6 may be distanced from each other by the circumference of the image carrying body 130 from a standpoint of the printing medium P, and the second unit section ΔZ in FIG. 6 may be a section overlapped with the first unit section ΔY in FIG. 6 as the image carrying body 130 makes one revolution from a standpoint of the image carrying body 130.

Figure 11A:
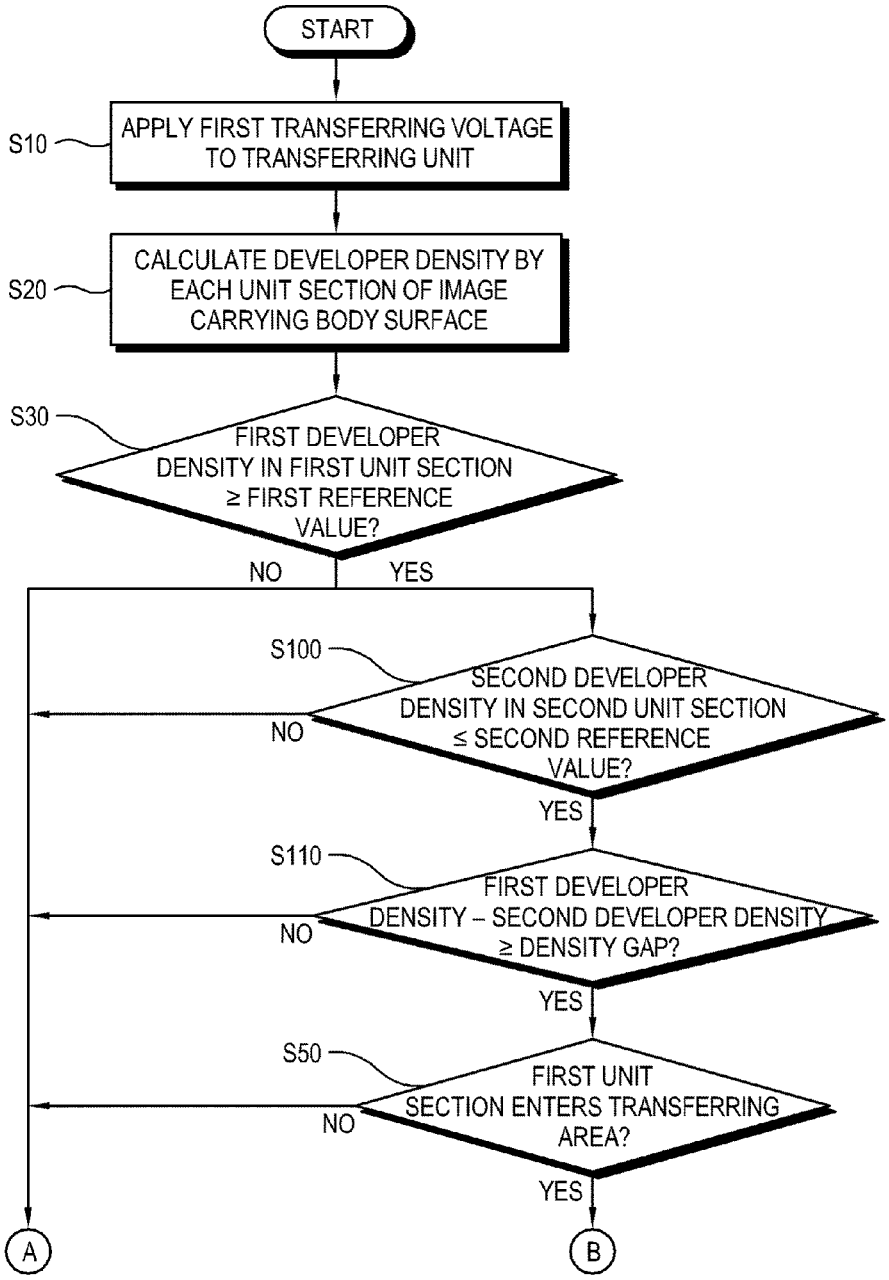
FIGS. 11A and 11B are flowcharts of a control method of an image forming apparatus according to another exemplary embodiment of the present general inventive concept.
Figure 11B:
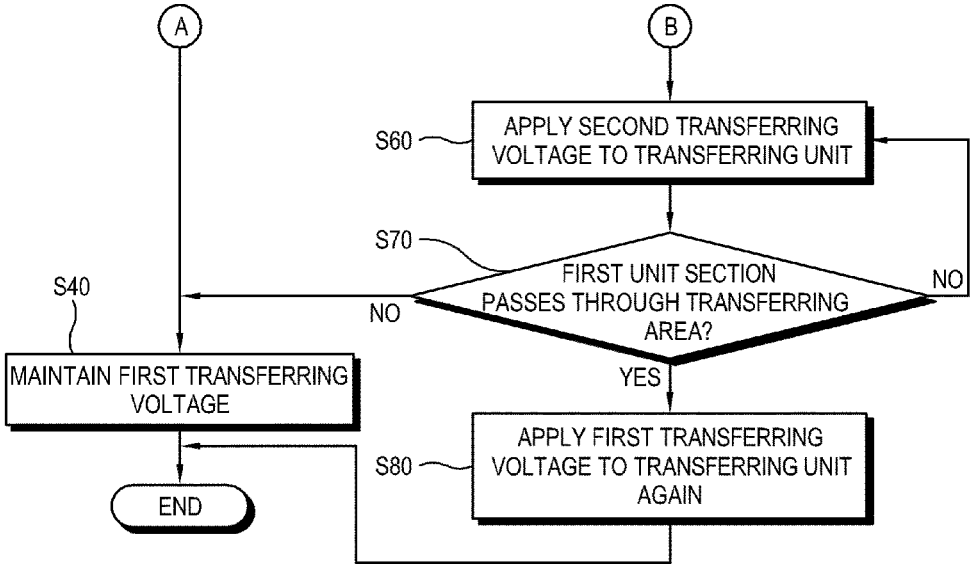

Hereinafter, a control method of an image forming apparatus according to another exemplary embodiment of the present general inventive concept will be described by referring to FIGS. 11A and 11B.

In the control method of the image forming apparatus according to another exemplary embodiment of the present general inventive concept, two operations S100 and S110 are added between the operations S30 and S50 in comparison to the first exemplary embodiment.

That is, if the first developer density in the first unit section ΔY is larger than the first reference value (YES of operation S30), then it is determined whether the second developer density in the second unit section ΔX and ΔZ is smaller than the second reference value (operation, S100).

If the second developer density is smaller than the second reference value (YES of operation S100), then it is determined whether the difference between the first developer density and the second developer density is larger than a density gap (operation, S110). The density gap may be a predetermined value, or a value selected by a user.

If the density difference is larger than the density gap (YES of operation S110), and the first unit section ΔY enters the transferring area (YES of operation S50), the second transferring voltage is applied to the transferring unit 140 instead of the first transferring voltage (operation, S60).

Hereinafter, a control method of an image forming apparatus according to another exemplary embodiment of the present general inventive concept will be described by referring to FIG. 12.

In the control method of the image forming apparatus according to another exemplary embodiment of the present general inventive concept, operations S120, S130, and S140 are added in comparison to the first exemplary embodiment.

At first, environmental temperature and/or humidity may be sensed (operation, S120). The temperature and/or humidity may be directly sensed through a separate temperature sensor and/or humidity sensor. As necessary, since the transferring unit 140 may be sensitive to the temperature and humidity, by applying a sensing voltage to the transferring unit 140, and using a voltage value feed back, the temperature and humidity may be indirectly sensed.

Then, the first transferring voltage may be applied to the transferring unit 140 (operation, S10), and a developer density by each unit section on a surface of the image carrying body 130 may be calculated (operation, S20). Here, the order of the operations S120, S10, and S20 may be changed.

Then, it is determined whether the first developer density in the first unit section ΔY is larger than the first reference value (operation, S30). In case of being smaller than the first reference value (NO of operation S30), the first transferring voltage may be maintained and continually applied to the transferring unit 140 (operation, S40).

In case of being larger than the first reference value (YES of operation S30), and if the first unit section ΔY on the surface of the image carrying body 130 enters the transferring area A (YES of operation S50), a second transferring voltage corresponding to the sensed temperature or humidity is selected (operation, S130), and the selected second transferring voltage is applied to the transferring unit 140 (operation, S140).

Figure 12:
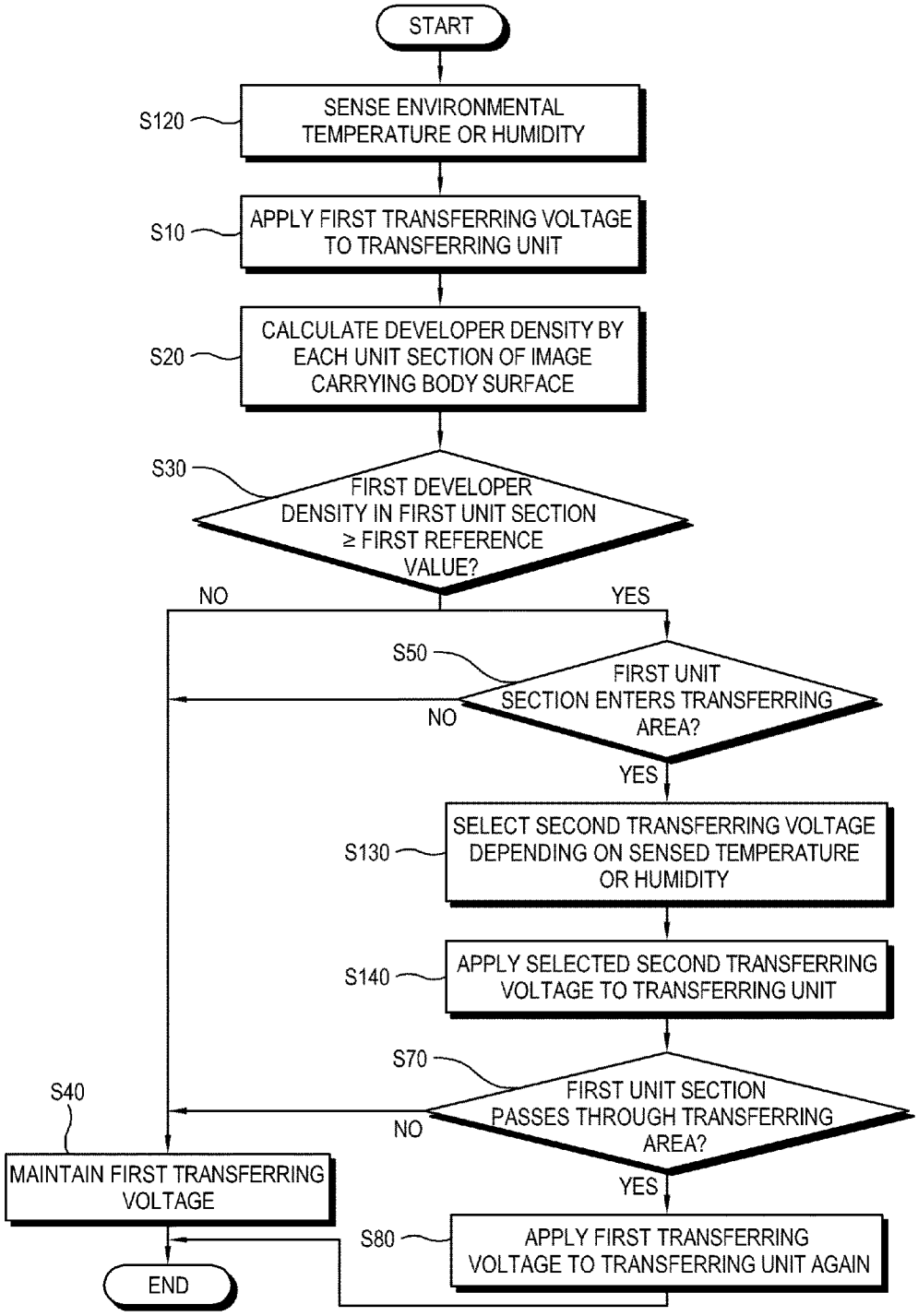
FIG. 12 is a flowchart of a control method of an image forming apparatus according to another exemplary embodiment of the present general inventive concept.

In the case of FIG. 12, storing at least one of the first transferring voltage and the second transferring voltage in a memory (not shown) may be further included. Also, the first transferring voltage may be provided to vary according to the sensed temperature and humidity.

In the case of FIG. 12, the second transferring voltage is in inverse proportion to the temperature and the humidity. That is, as the temperature or humidity decreases, the second transferring voltage increases.

Figure 13A:
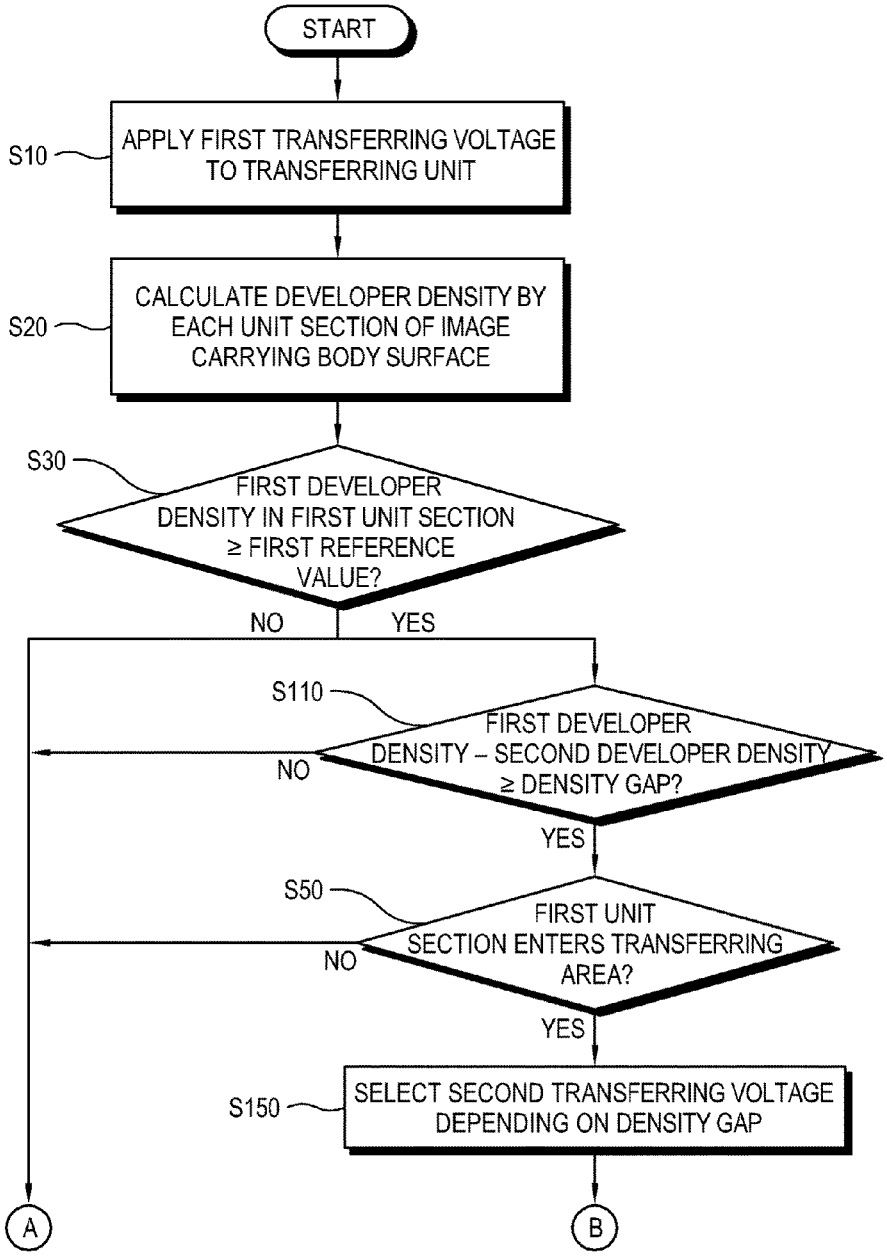
FIGS. 13A and 13B are flowcharts of a control method of an image forming apparatus according to another exemplary embodiment of the present general inventive concept.
Figure 13B:
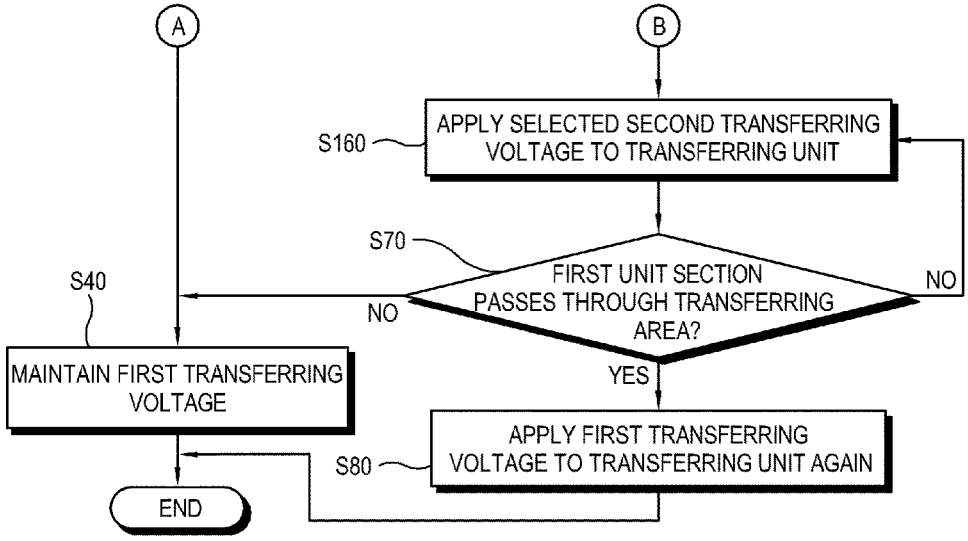

Hereinafter, a control method of an image forming apparatus according to another exemplary embodiment of the present general inventive concept will be described by referring to FIGS. 13A and 13B.

In the control method of the image forming apparatus according to another exemplary embodiment of the present general inventive concept, operations S150 and S160 are added in comparison to another exemplary embodiment.

That is, if the first developer density in the first unit section ΔY is larger than the first reference value (YES of operation S30), then it is determined whether the difference between the first developer density and the second developer density in the second unit section is larger than a predetermined density gap (operation, S90).

If the difference between the first developer density and the second developer density is larger than the density gap (YES of operation S90), and the first unit section ΔY enters the transferring area (YES of operation S50), a second transferring voltage corresponding to the density gap is selected (operation, S150).

Then, the selected second transferring voltage is applied to the transferring unit 140 (operation, S160).

As described above, in the control method of the image forming apparatus according to the present general inventive concept, conditions for applying the second transferring voltage may be variously changed to remove an image ghost.

In the above exemplary embodiments, the developer may be a negative charge developer charged to have a negative polarity, and the transferring voltage has a positive polarity. Alternatively, in case of a positive charge developer, that is, if the developer is charged to have a positive polarity and the transferring voltage has a negative polarity, the same general inventive concept as the above exemplary embodiments may be applied thereto. In this case, a level relation of the absolute values of the first transferring voltage and the second transferring voltage may be the same as the above exemplary embodiments.

Also, in the above exemplary embodiments, a constant voltage type controlling a current to uniformly maintain the transferring voltage of the transferring unit 140 is exemplary described. Alternatively, the present general inventive concept may be applied to a constant current type controlling a voltage application to uniformly maintain a transferring current of the transferring unit 140. In this case, the transferring voltage according to the above exemplary embodiments may be replaced by the transferring current, and a current applying method may be the same as the above voltage applying method. Accordingly, the method of controlling the transferring voltage or the transferring current may be commonly named as a method of controlling transferring electric power.

Also, in the above exemplary embodiments, the image carrying body 130 and the transferring unit 140 face each other, and the developer on the image carrying body 130 may be transferred on the printing medium entering the transferring nip by an electric field generated by applying the transferring electric power source. Alternatively, the image carrying body 130 may be a photosensitive drum, or an image carrying belt, and the transferring unit 140 may be a transferring belt as well as the roller type.

Also, in the exemplary embodiments, the image carrying body 130 may be disposed to an upper side with respect to a transferring surface to which a developer of a printing medium is transferred, and the transferring unit 140 may be positioned to a lower side thereof. Alternatively, the present general inventive concept may be applied to an image forming apparatus having a configuration in which one of the image carrying body 130 and the transferring unit 140 has a belt type, and the image carrying body and the transferring unit having the belt type are positioned to a side of a developer transferring surface of a printing medium, and a power source control similar to the above exemplary embodiments may be applied to the image forming apparatus.

Also, the present general inventive concept may be applied to a configuration in which a backup roller is positioned to face a transferring unit and a belt, and a transferring nip among the transferring unit, belt and backup roller may be uniformly maintained.

An image forming apparatus and a control method thereof according to the present invention have the following features.

First, an image ghost may be removed or reduced to improve a printing image quality.

Second, a space efficiency is improved to make a smaller product.

Third, manufacturing cost is reduced.

Although a few exemplary embodiments of the present general inventive concept have been shown and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming apparatus, comprising:

an image carrying body which comprises a surface on which a developer which corresponds to printing data is applied;

a transferring unit which receives transferring electric power to form a transferring area which transfers the developer to a transferring target body;

a power supply unit which applies the transferring electric power to the transferring unit; and a control unit which controls the power supply unit to apply first transferring electric power or second transferring electric power based on the amount of the developer in a unit section on the surface of the image carrying body to the transferring unit, wherein the control unit controls the power supply unit to apply the second transferring electric power to the transferring unit while a first unit section passes through the transferring area if a first developer amount in the first unit section is larger than a first reference value.

2. The image forming apparatus according to claim 1, wherein the control unit controls the power supply unit to change the transferring electric power from the first transferring electric power to the second transferring electric power if a difference between the first developer amount and a second developer amount in a second unit section is larger than a predetermined amount gap.

3. The image forming apparatus according to claim 2, wherein the first unit section and the second unit section are vicinal to each other, or the second unit section is overlapped with the first unit section as the image carrying body makes one revolution.

4. The image forming apparatus according to claim 2, wherein the control unit controls the power supply unit to change the second transferring electric power depending on at least one of temperature, humidity, and the amount gap.

5. The image forming apparatus according to claim 4, wherein the control unit controls the power supply unit so that the second transferring electric power can be in proportion to the amount gap, or the second transferring electric power can be in inverse proportion to the temperature or humidity.

6. The image forming apparatus according to claim 1, wherein the control unit controls the power supply unit to apply a third transferring electric power to the transferring unit after applying the first transferring electric power and the second transferring electric power to the transferring unit.

7. The image forming apparatus according to claim 6, wherein the first transferring electric power and the third transferring electric power have the same level.

8. The image forming apparatus according to claim 1, wherein the control unit controls the power supply unit to apply the first transferring electric power to the transferring unit after the first unit section passes through the transferring area.

9. The image forming apparatus according to claim 1, wherein the absolute value of the second transferring electric power is larger than that of the first transferring electric power.

10. The image forming apparatus according to claim 1, further comprising a memory which stores information about at least one of the first transferring electric power and the second transferring electric power.

11. The image forming apparatus according to claim 1, wherein the printing data comprises bitmap data, and the control unit calculates the developer amount in the unit section by using the bitmap data.

12. An image forming apparatus, comprising:

an image carrying body which comprises a surface on which a developer which corresponds to printing data is applied;

a transferring unit which receives transferring electric power to form a transferring area which transfers the developer to a transferring target body;

a power supply unit which applies the transferring electric power to the transferring unit; and a control unit which controls the power supply unit to apply first transferring electric power or second transferring electric power based on the amount of the developer in a unit section on the surface of the image carrying body to the transferring unit, wherein the control unit controls the power supply unit to apply the second transferring electric power to the transferring unit while a first unit section passes through the transferring area if a first developer amount in the first unit section is larger than a first reference value, and a second developer amount in a second unit section is smaller than a second reference value.

13. A control method of an image forming apparatus which comprises an image carrying body which comprises a surface on which a developer which corresponds to printing data is applied, and a transferring unit which receives transferring electric power to form a transferring area which transfers the developer to a transferring target body, the control method of the image forming apparatus comprising:

applying first transferring electric power to the transferring unit; and applying second transferring electric power to the transferring unit based on the amount of the developer in a unit section on the surface of the image carrying body, wherein the applying the second transferring electric power comprises applying the second transferring electric power while a first unit section passes through the transferring area if a first developer amount in the first unit section is larger than a first reference value.

14. The control method of the image forming apparatus according to claim 13, wherein the applying the second transferring electric power further comprises applying the second transferring electric power if a difference between the first developer amount and a second developer amount in a second unit section is larger than a predetermined amount gap.

15. The control method of the image forming apparatus according to claim 14, wherein the first unit section and the second unit section are vicinal to each other, or the second unit section is overlapped with the first unit section as the image carrying body makes one revolution.

16. The control method of the image forming apparatus according to claim 14, further comprising selecting the second transferring electric power depending on at least one of temperature, humidity, and the amount gap.

17. The control method of the image forming apparatus according to claim 16, wherein the second transferring electric power is in proportion to the amount gap, or is in inverse proportion to the temperature or humidity.

18. The control method of the image forming apparatus according to claim 13, further comprising applying a third transferring electric power to the transferring unit after applying the first transferring electric power and the second transferring electric power supply to the transferring unit.

19. The control method of the image forming apparatus according to claim 18, wherein the first transferring electric power and the third transferring electric power have the same level.

20. The control method of the image forming apparatus according to claim 13, further comprising applying the first transferring electric power to the transferring unit again after the first unit section passes through the transferring area.

21. The control method of the image forming apparatus according to claim 13, wherein the absolute value of the second transferring electric power is larger than that of the first transferring electric power.

22. The control method of the image forming apparatus according to claim 13, further comprising storing information about at least one of the first transferring electric power and the second transferring electric power.

23. The control method of the image forming apparatus according to claim 13, wherein the printing data comprises bitmap data, and the control method of the image forming apparatus further comprises calculating the developer amount in the unit section by using the bitmap data.

24. A control method of an image forming apparatus which comprises an image carrying body which comprises a surface on which a developer which corresponds to printing data is applied, and a transferring unit which receives transferring electric power to form a transferring area which transfers the developer to a transferring target body, the control method of the image forming apparatus comprising:

applying first transferring electric power to the transferring unit; and applying second transferring electric power to the transferring unit based on the amount of the developer in a unit section on the surface of the image carrying body, wherein the applying the second transferring electric power comprises applying the second transferring electric power while a first unit section passes through the transferring area if a first developer amount in the first unit section is larger than a first reference value, and a second developer amount in a second unit section is smaller than a second reference value.

25. A control method of an image forming apparatus which comprises an image carrying body which comprises a surface on which a developer for printing data is applied, and a transferring unit which receives transferring electric power to form a transferring area which transfers the developer to a transferring target body, the control method of the image forming apparatus comprising:

applying first transferring electric power to the transferring unit; and applying second transferring electric power to the transferring unit based on a density gap between a first developer density at a first unit section on the surface of the image carrying body and a second developer density at a second unit section on the surface of the image carrying body for preventing the formation of an image ghost due to inequality of surface electric potential of the image carrying body.

26. The control method of the image forming apparatus according to claim 25, wherein the transferring target body constitutes a printing medium or a transferring belt to which the developer visible image of the image carrying body is transferred by the transferring unit.

27. The control method of the image forming apparatus according to claim 25, wherein the difference in developer density per unit section is converted into a difference in developer density per a unit of time.

* * * * *